US006364288B1

(12) United States Patent
Laughlin

(10) Patent No.: US 6,364,288 B1
(45) Date of Patent: Apr. 2, 2002

(54) AIR-DRIVEN NAIL PULLER DEVICE

(76) Inventor: Benjamin L. Laughlin, 2251 E. Rippling Way Ct. #E, Indianapolis, IN (US) 46260-7295

( * ) Notice: Subject to any disclaimer, the term of this patent is extended or adjusted under 35 U.S.C. 154(b) by 0 days.

(21) Appl. No.: 09/607,352

(22) Filed: Jun. 30, 2000

(51) Int. Cl.[7] ..... B66F 15/00
(52) U.S. Cl. ..... 254/18
(58) Field of Search ..... 254/18, 30; 29/252

(56) References Cited

U.S. PATENT DOCUMENTS

| | | | | |
|---|---|---|---|---|
| 2,597,594 A | | 5/1952 | Nissley | |
| 2,706,103 A | | 4/1955 | Stambaugh | |
| 3,643,918 A | | 2/1972 | Ellis | |
| 3,746,306 A | | 7/1973 | Ellis et al. | |
| 3,978,576 A | * | 9/1976 | Mustoe | 254/18 |
| 5,163,519 A | | 11/1992 | Mead et al. | |
| D334,329 S | | 3/1993 | Ogawa et al. | |

* cited by examiner

*Primary Examiner*—Robert C. Watson

(57) ABSTRACT

An air-driven nail puller device for easily and quickly removing a nail from a structure. The air-driven nail puller device includes a housing having an elongate first end portion, an open first end, a second end, and a handle portion being disposed intermediate of the first and second ends with the elongate first end portion having a bore extending therethrough; and further includes a tubular shaft support member disposed within said housing and having a side wall; and also includes a drive shaft being movably disposed in the housing and having a first end and a second end; and further includes an engaging and clamping assembly for engaging and clamping about a nail head; and further includes an impacting assembly for forcing the first end of the drive shaft outwardly of the housing so that the engaging and clamping assembly engages and clamps about a nail head; and also includes a retraction assembly for retracting the first end of the drive shaft within the housing through the open first end.

11 Claims, 6 Drawing Sheets

AIR-DRIVEN NAIL PULLER DEVICE

BACKGROUND OF THE INVENTION

1. Field of the Invention

The present invention relates to a pneumatic nail puller and more particularly pertains to a new air-driven nail puller device for easily and quickly removing a nail from a structure.

2. Description of the Prior Art

The use of a pneumatic nail puller is known in the prior art. More specifically, a pneumatic nail puller heretofore devised and utilized are known to consist basically of familiar, expected and obvious structural configurations, notwithstanding the myriad of designs encompassed by the crowded prior art which have been developed for the fulfillment of countless objectives and requirements..

Known prior art includes U.S. Pat. No. 3,746,306; U.S. Pat. No. 3,643,918; U.S. Pat. No. 2,706,103; U.S. Pat. No. 2,597,594; U.S. Pat. No. 5,163,519; and U.S. Pat. No. Des. 334,329.

While these devices fulfill their respective, particular objectives and requirements, the aforementioned patents do not disclose a new air-driven nail puller device. The inventive device includes a housing having an elongate first end portion, an open first end, a second end, and a handle portion being disposed intermediate of the first and second ends with the elongate first end portion having a bore extending therethrough; and further includes a tubular shaft support member disposed within said housing and having a side wall; and also includes a drive shaft being movably disposed in the housing and having a first end and a second end; and further includes an engaging and clamping assembly for engaging and clamping about a nail head; and further includes an impacting assembly for forcing the first end of the drive shaft outwardly of the housing so that the engaging and clamping assembly engages and clamps about a nail head; and also includes a retraction assembly for retracting the first end of the drive shaft within the housing through the open first end.

In these respects, the air-driven nail puller device according to the present invention substantially departs from the conventional concepts and designs of the prior art, and in so doing provides an apparatus primarily developed for the purpose of easily and quickly removing a nail from a structure.

SUMMARY OF THE INVENTION

In view of the foregoing disadvantages inherent in the known types of pneumatic nail puller now present in the prior art, the present invention provides a new air-driven nail puller device construction wherein the same can be utilized for easily and quickly removing a nail from a structure.

The general purpose of the present invention, which will be described subsequently in greater detail, is to provide a new air-driven nail puller device which has many of the advantages of the pneumatic nail puller mentioned heretofore and many novel features that result in a new air-driven nail puller device which is not anticipated, rendered obvious, suggested, or even implied by any of the prior art pneumatic nail puller, either alone or in any combination thereof.

To attain this, the present invention generally comprises a housing having an elongate first end portion, an open first end, a second end, and a handle portion being disposed intermediate of the first and second ends with the elongate first end portion having a bore extending therethrough; and further includes a tubular shaft support member disposed within said housing and having a side wall; and also includes a drive shaft being movably disposed in the housing and having a first end and a second end; and further includes an engaging and clamping assembly for engaging and clamping about a nail head; and further includes an impacting assembly for forcing the first end of the drive shaft outwardly of the housing so that the engaging and clamping assembly engages and clamps about a nail head; and also includes a retraction assembly for retracting the first end of the drive shaft within the housing through the open first end.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new air-driven nail puller device which has many of the advantages of the pneumatic nail puller mentioned heretofore and many novel features that result in a new air-driven nail puller device which is not anticipated, rendered obvious, suggested, or even implied by any of the prior art pneumatic nail puller, either alone or in any combination thereof.

It is another object of the present invention to provide a new air-driven nail puller device which may be easily and efficiently manufactured and marketed.

It is a further object of the present invention to provide a new air-driven nail puller device which is of a durable and reliable construction.

An even further object of the present invention is to provide a new air-driven nail puller device which is susceptible of a low cost of manufacture with regard to both materials and labor, and which accordingly is then susceptible of low prices of sale to the consuming public, thereby making such air-driven nail puller device economically available to the buying public.

Still yet another object of the present invention is to provide a new air-driven nail puller device which provides in the apparatuses and methods of the prior art some of the advantages thereof, while simultaneously overcoming some of the disadvantages normally associated therewith.

Still another object of the present invention is to provide a new air-driven nail puller device for easily and quickly removing a nail from a structure.

Yet another object of the present invention is to provide a new air-driven nail puller device which includes a housing having an elongate first end portion, an open first end, a second end, and a handle portion being disposed intermediate of the first and second ends with the elongate first end portion having a bore extending therethrough; and further includes a tubular shaft support member disposed within said housing and having a side wall; and also includes a drive shaft being movably disposed in the housing and having a first end and a second end; and further includes an engaging and clamping assembly for engaging and clamping about a nail head; and further includes an impacting assembly for forcing the first end of the drive shaft outwardly of the housing so that the engaging and clamping assembly engages and clamps about a nail head; and also includes a retraction assembly for retracting the first end of the drive shaft within the housing through the open first end.

Still yet another object of the present invention is to provide a new air-driven nail puller device that automatically removes nails from structures.

Even still another object of the present invention is to provide a new air-driven nail puller device that saves time and eliminates using electricity or fuel to energize the motor within the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
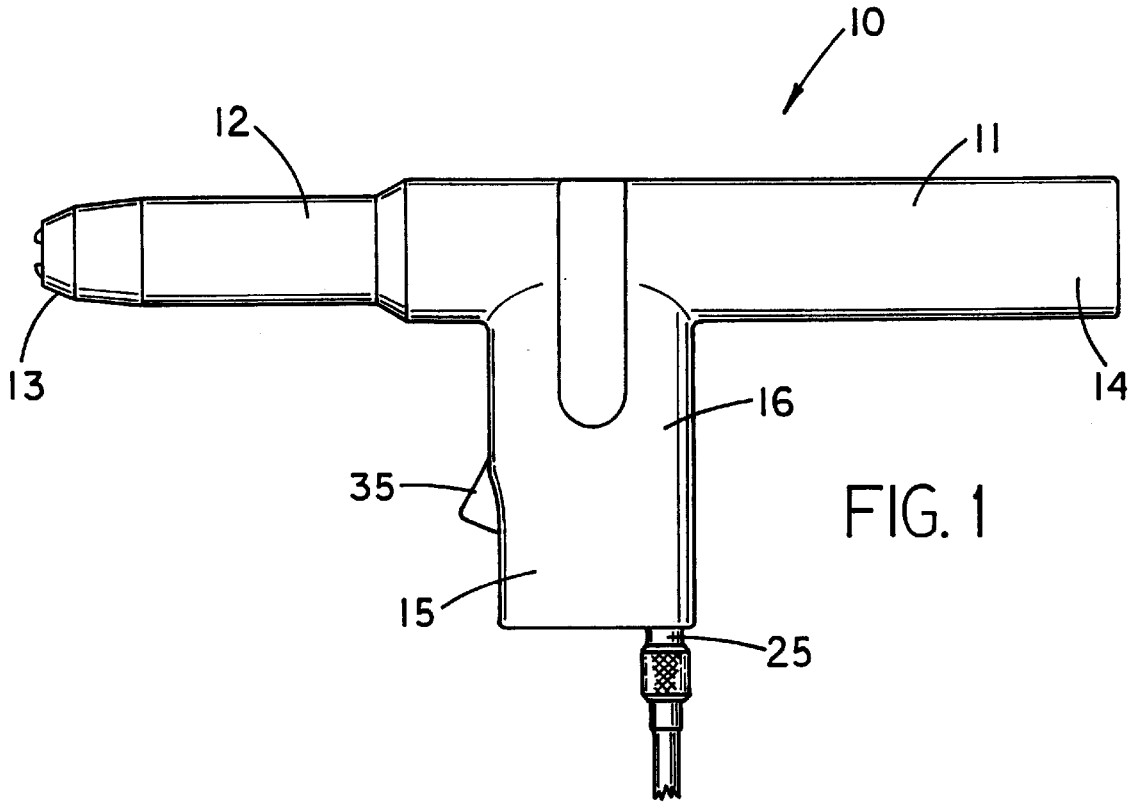
FIG. 1 is a side elevational view of a new air-driven nail puller device according to the present invention.
Figure 2:
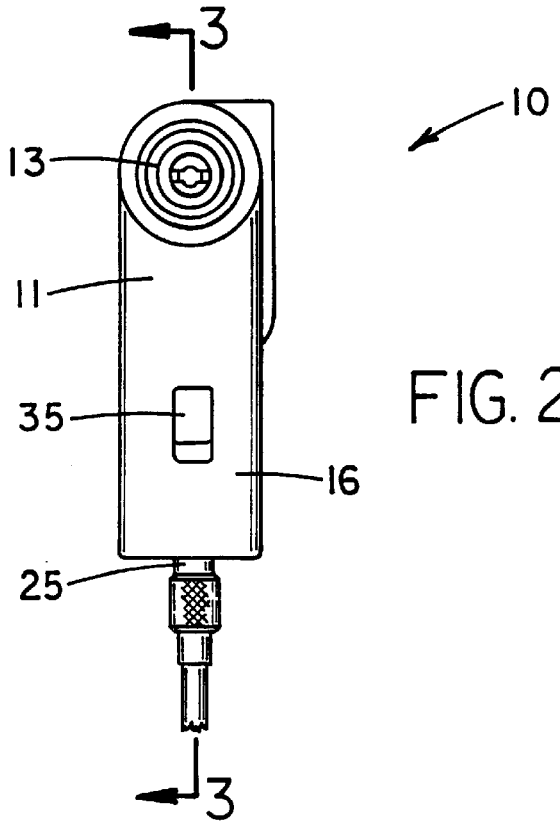
FIG. 2 is an end elevational view of the present invention.
Figures 3, 4:
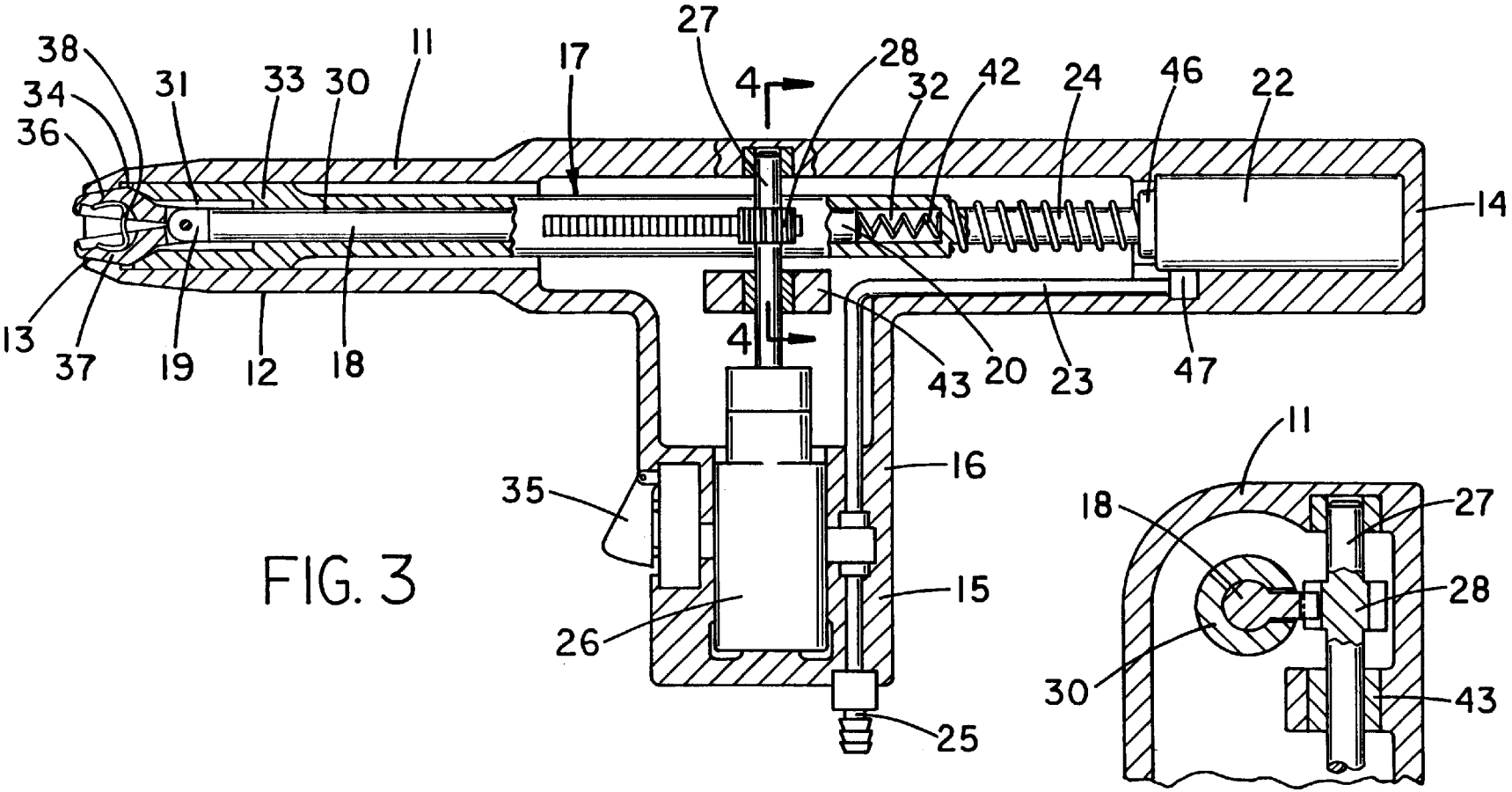
FIG. 3 is a side cross-sectional view of the present invention.
FIG. 4 is a detailed cross-sectional view of the motor shaft, gear member and drive shaft of the present invention.
Figure 5:
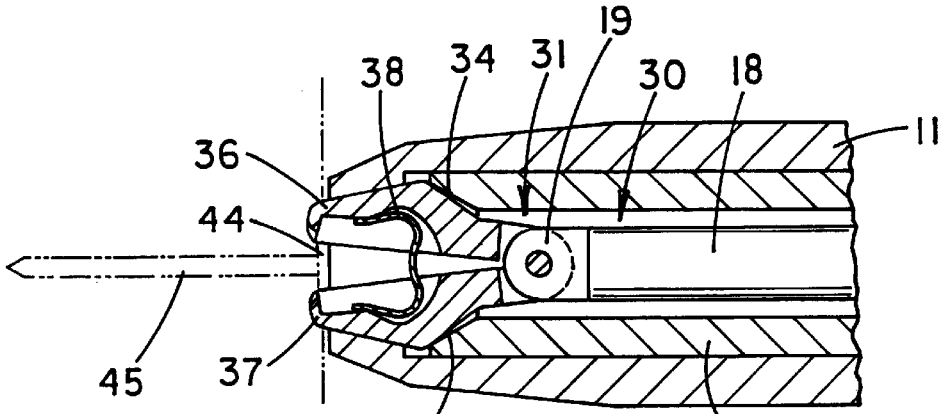
FIG. 5 is a detailed cross-sectional view of the first end portion of a first embodiment of the present invention with the jaw-like members being spread apart.
Figure 6:
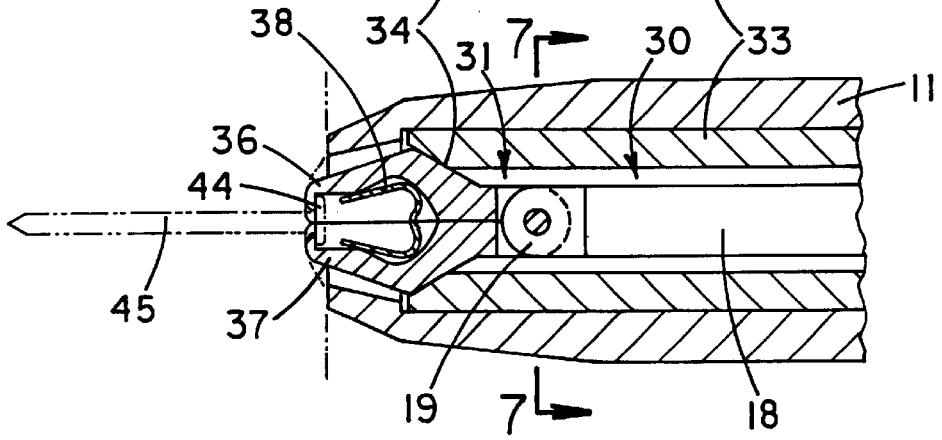
FIG. 6 is a detailed cross-sectional view of the first end portion of the first embodiment of the present invention with the jaw-like member being closed about a nail head.
Figure 7:
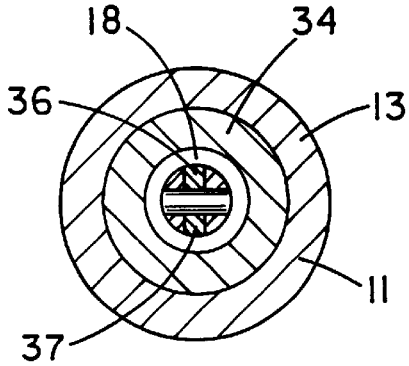
FIG. 7 is a cross-sectional view of the first end portion of the first embodiment of the present invention.
Figure 8:
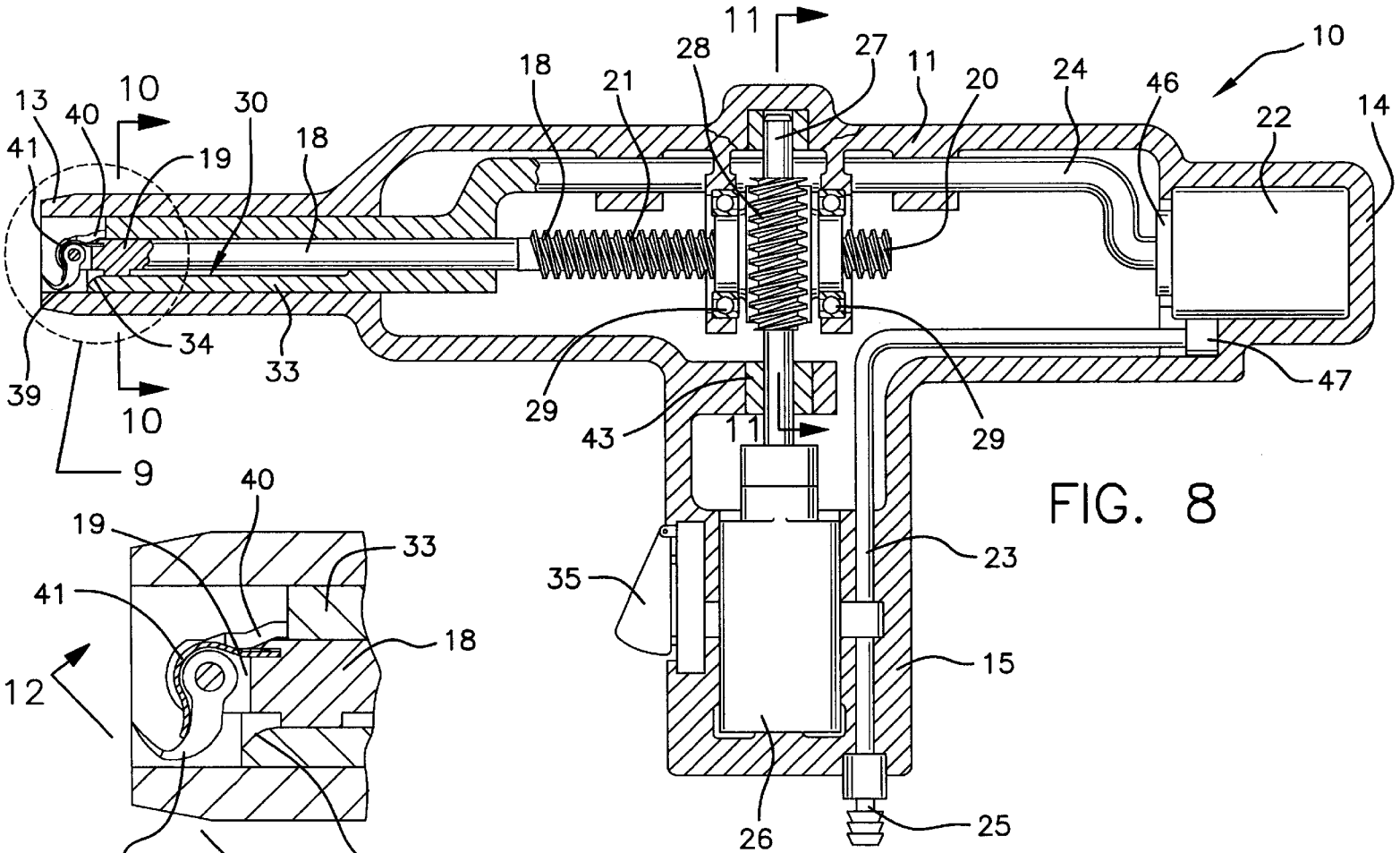
FIG. 8 is a cross-sectional view of a second embodiment of the present invention.
Figure 9:
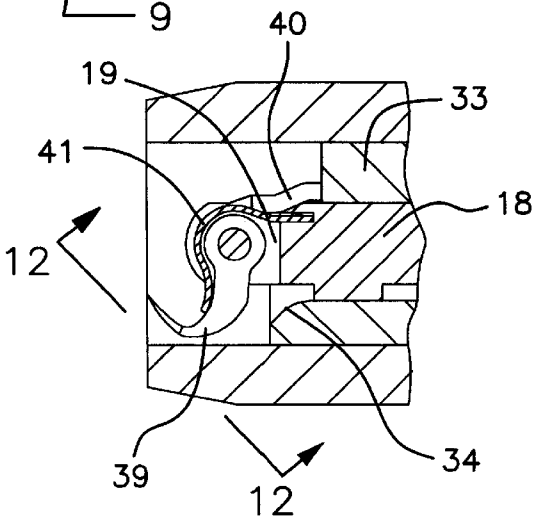
FIG. 9 is a detailed cross-sectional view of the first end portion of the second embodiment of the present invention.
Figure 11:
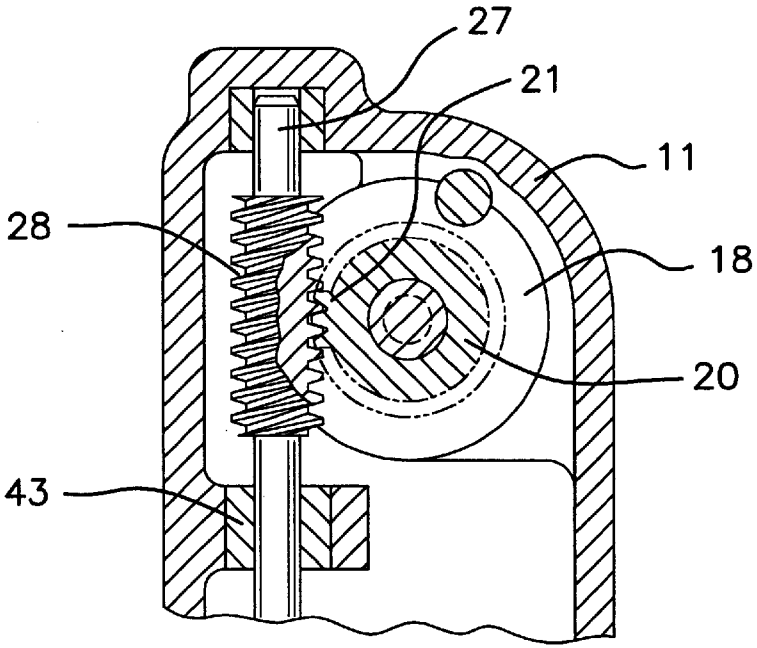
FIG. 11 is a cross-sectional view of the gear member, drive shaft and motor shaft of the second embodiment of the present invention.
Figure 10:
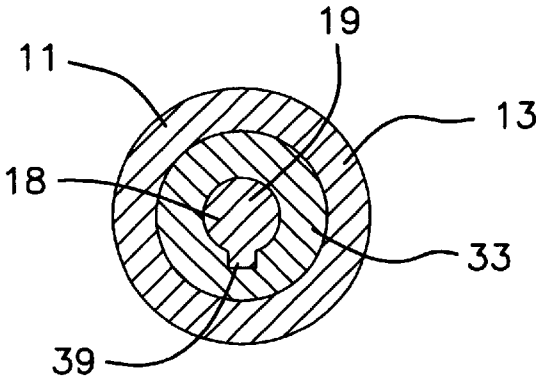
FIG. 10 is a cross-sectional view of the first end portion of the second embodiment of the present invention.
Figure 12:
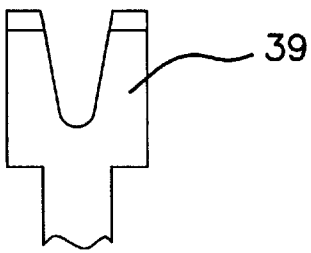
FIG. 12 is a detailed side elevational view of the hook-like member of the present invention.
Figure 13:
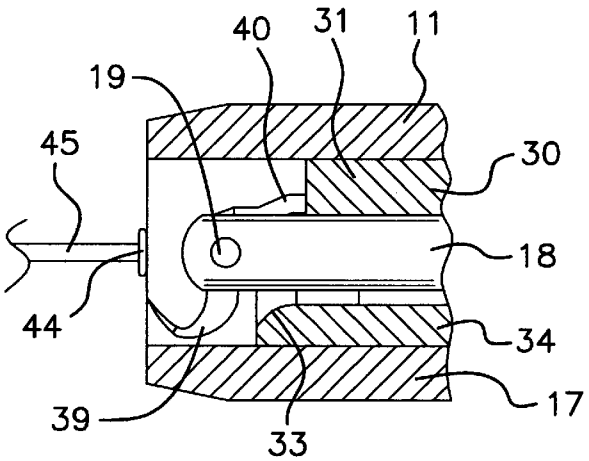
FIG. 13 is a detailed cross-sectional view of the first end portion of the second embodiment of the present invention with the drive shaft being moved toward the first end of the housing.
Figure 14:
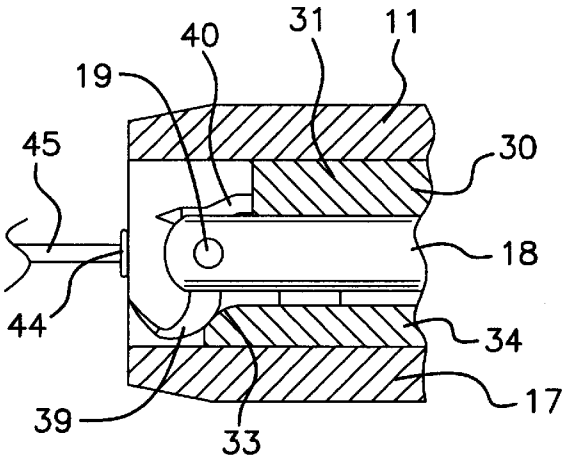
FIG. 14 is a detailed cross-sectional view of the first end portion of the second embodiment of the present invention with the spike-like member being moved toward the first end of the housing.
Figure 15:
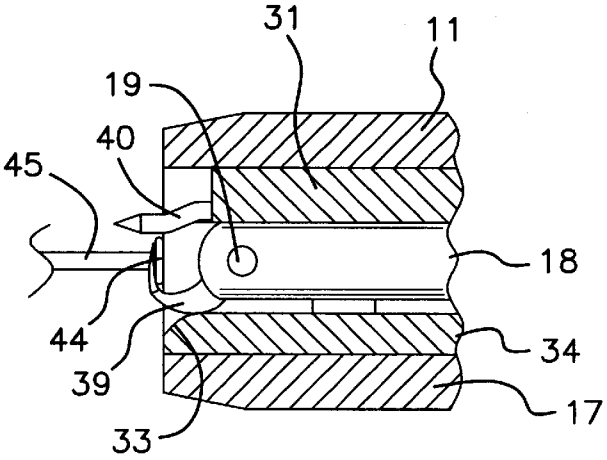
FIG. 15 is a detailed cross-sectional view of the first end portion of the second embodiment of the present invention with the hook-like member being engaged about the nail head.
Figure 16:
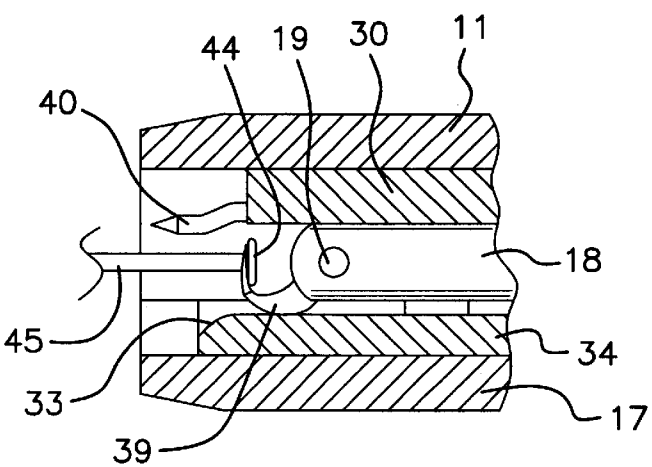
FIG. 16 is a detailed cross-sectional view of the first end portion of the second embodiment of the present invention with the hook-like member being retracted within the housing and extracting the nail from the structure.

With reference now to the drawings, and in particular to FIGS. 1 through 16 thereof, a new air-driven nail puller device embodying the principles and concepts of the present invention and generally designated by the reference numeral 10 will be described.

As best illustrated in FIGS. 1 through 16, the air-driven nail puller device 10 generally comprises a housing 11 having an elongate first end portion 12, an open first end 13, a second end 14, and a handle portion 15 being disposed intermediate of the first and second ends 13,14. The elongate first end portion 12 has a bore 17 extending therethrough. A tubular shaft support member 30 is securely disposed within the housing and has a side wall 33. A drive shaft 18 is movably disposed in the housing 11 and has a first end 19 and a second end 20. The air-driven nail puller device 10 also comprises a means for engaging and clamping about a nail head 44. A means for forcing the first end 19 of the drive shaft 18 outwardly of the housing 11 so that the means for engaging and clamping about a nail head 44 impacts a structure includes an air cylinder 22 having an air-inlet port 47 and an air-outlet port 46, and also includes a tubular member 24 having a bore extending therethrough and having a first end being securely attached to the air-outlet port 46 of the air cylinder 22 and also having a second end being disposed proximate to the tubular shaft support member 30, and further includes a spring 42 disposed inside the tubular member 24 and being biasedly disposed against the second end 20 of the drive shaft 18; and also includes a conduit member 23 having one end securely attached to the air-inlet port 47; and further includes a hose attachment fitting 25 securely disposed through a wall 16 of the housing 11 and being securely and conventionally connected to the conduit member 23 and being adapted to be connected to an air source.

A means for retracting the first end 19 of the drive shaft 18 within the housing 11 through the open first end 13 includes an air motor 26 securely and conventionally disposed within the handle portion 15 of the housing 11 and being conventionally connected to the conduit member 23 and having a motor shaft 27 rotatably conventionally connected to the air motor 26; and also includes a gear member 28 being securely and conventionally mounted to the motor shaft 27 and being engagable to the drive shaft 18 for retracting the drive shaft 18 within the housing 11; and further includes a trigger switch 35 being securely, movably and conventionally disposed in the wall 16 of the housing 11 and being conventionally connected to the air motor 26 for the energizing thereof. The motor shaft 27 is journaled through bearings 43 and into the wall 16 of the housing 11 with the elongate tubular shaft support member 30 further having an open first end 31 which is disposed near the first end 13 of the housing 11, and also having an open second end 32 to which the second end of the tubular member 24 is conventionally attached, and further having a side wall 33,34 which is outwardly tapered at the first end 31 of the tubular shaft support member 30.

As a first embodiment, the means for engaging and clamping about a nail head 44 includes a pair of opposed jaw-like members 36,37 being pivotally attached to the first end 19 of the drive shaft 18 and being retractably extendable outwardly through the first end 13 of the housing 11 and being engageable and clampable about the nail head 44, and also includes a spring member 38 being securely disposed between and engaged to the jaw-like members 36,37 for biasing the jaw-like members 36,37 away from one another to allow the nail head 44 to be received therebetween. The jaw-like members 36,37 are urged toward one another and are adapted to clamp about the nail head 44 by the side wall 33,34 of the tubular shaft support member 30 upon the drive shaft 18 being retracted within the housing 11. The jaw-like members 36,37 are movable within the tubular shaft support member 30 and are engageable to the side wall 33,34 thereof.

As a second embodiment, the means for engaging and clamping about a nail head 44 includes a hook-like member 39 being pivotally and conventionally attached at the first end 19 of the drive shaft 18 and being adapted to hook about the nail head 44 of a nail 45, and further includes a spring 41 which is securely attached to the hook-like memeber 39 and to the drive shaft 18 for biasing the hook-like member 39 away from the nail head 44, and also includes a spike-like member 40 being securely attached to the first end 19 of the drive shaft 18 and being adapted to penetrate into a structure about the nail head 44 upon the tubular shaft support member 30 being moved by pressurized air through the bore 17 of the housing 11 toward the first end 13 thereof with the hook-like member 39 being adapted to hook about the nail head 44 of the nail 45 upon the hook-like member 39 being retracted within the tubular shaft support member 30. The hook-like member 39 is movable within the tubular shaft support member 30 and is engageable to the side wall 33,34 of the tubular shaft support member 30. The gear member 28 is essentially a worm gear, and the drive shaft 18 includes a spirally threaded second end portion 21 which is engageable to the worm gear 28 for retracting the drive shaft 18 within the housing 11. The second end portion 21 of the drive shaft 18 is extendable through and supported by support members 29 which are securely attached to the housing 11.

In use, the user places the open first end 13 of the housing 11 about a nail head 44 of a nail 45 disposed in a structure and allows air from an pressurized air source to enter the air cylinder 22 which either drives the drive shaft 18 within the housing 11 or the tubular shaft support member 30 within the housing 11 with the means for engaging and clamping about the nail head 44 impacting the structure about the nail head 44. The user than depresses the trigger switch 35 which energizes the air motor 26 which retracts the drive shaft 18 within the housing 11. As the drive shaft 1 8 is retracted, the side wail 33,34 of the tubular shaft support member 30 urges either the jaw-like members 36,37 together to clamp about the nail head 44 or the hook-like member 39 to hook about the nail head 44, and as the drive shaft 18 is retracted within the housing 11 even farther, the nail 45 is removed from the structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An air-driven nail puller device comprising a housing having an elongate first end portion, an open first end, a second end, and a handle portion being disposed intermediate of said first and second ends, said elongate first end portion having a bore extending therethrough;

a tubular shaft support member disposed inside said housing and having a side wall;

a drive shaft movably disposed in said housing and having a first end and a second end;

a means for engaging and clamping about a nail head;

a means for forcing said first end of said drive shaft outwardly of said housing; and a means for retracting said first end of said drive shaft within said housing through said open first end.

2. An air-driven nail puller device as described in claim 1, wherein said means for forcing said first end of drive shaft outwardly of said housing includes:

an air cylinder having an air-inlet port and an air-outlet port;

a tubular member having a bore extending therethrough and having a first end being attached to said air-outlet port of said air cylinder and also having a second end being disposed proximate to said tubular shaft support member;

a conduit member having one end attached to said air-inlet port; and a hose attachment fitting disposed through a wall of said housing and being connected to said conduit member and being adapted to be connected to an air source.

3. An air-driven nail puller device as described in claim 2, wherein said means for retracting said first end of said drive shaft within said housing includes:

an air motor disposed in said housing and being connected to said conduit member and having a motor shaft rotatably connected to said air motor;

a gear member being mounted to said motor shaft and being engagable to said drive shaft for retracting said drive shaft within said housing; and a trigger switch being movably disposed in said wall of said housing and being connected to said air motor for energizing said air motor.

4. An air-driven nail puller device as described in claim 3, wherein said motor shaft is journaled through bearings and into said wall of said housing.

5. An air-driven nail puller device as described in claim 4, wherein said tubular shaft support member is disposed in said bore of said housing, said tubular shaft support member including:

an open first end which disposed near said first end of said housing;

an open second end to which said second end of said tubular member is connected;

a side wall which is outwardly tapered at said first end of said tubular shaft support member.

6. An air-driven nail puller device as described in claim 1, wherein said means for engaging a nail head includes a hook-like member for hooking the nail head of a nail by penetrating a structure supporting the nail from a single side and extending past a shaft of the nail, the hook-like member having a channel formed therein for receiving the shaft of the nail when said hook-like member hooks the nail head.

7. An air-driven nail puller device as described in claim 6, wherein said hook-like member is pivotally attached at said first end of said drive shaft for hooking about the nail head of a nail;

wherein said means for engaging and clamping about a nail head further includes:

a spring attached to said hook-like member and to said drive shaft for biasing said hook-like member away from the nail head; and a spike-like member attached to said first end of said tubular shaft support member for penetrating into a structure about the nail head as said tubular shaft support member is moved by pressurized air through said bore of said housing toward said first end thereof.

8. An air-driven nail puller device as described in claim 7, wherein said hook-like member is adapted to hook about the nail head of the nail upon said hook-like member being retracted into said tubular shaft support member, said hook-like member being movable in said tubular shaft support member and being engageable to a side wall of said tubular shaft support member.

9. An air-driven nail puller device as described in claim 8, wherein said gear member is a worm gear and said drive shaft includes a spirally threaded second end portion which is engageable to said worm gear for retracting said drive shaft in said housing, said second end portion of said drive shaft being extendable through and supported by support members, said support members being attached to said housing.

10. An air-driven nail puller device comprising a housing having an elongate first end portion, an open first end, a second end, and a handle portion being disposed intermediate of said first and second ends, said elongate first end portion having a bore extending therethrough;

a tubular shaft support member disposed inside said housing and having a side wall;

a drive shaft movably disposed in said housing and having a first end and a second end;

a means for engaging a nail head;

a means for forcing said first end of said drive shaft outwardly of said housing; and a means for retracting said first end of said drive shaft within said housing through said open first end;

wherein said means for engaging a nail head includes a hook-like member for hooking the nail head of a nail by penetrating a structure supporting the nail from a single side and extending past a shaft of the nail, the hook-like member having a channel formed therein for receiving the shaft of the nail when said hook-like member hooks the nail head;

wherein said hook-like member is pivotally attached at said first end of said drive shaft for hooking about the nail head of a nail;

wherein said means for engaging and clamping about a nail head further includes:

a spring attached to said hook-like member and to said drive shaft for biasing said hook-like member away from the nail head; and a spike-like member attached to said first end of said tubular shaft support member for penetrating into a structure about the nail head as said tubular shaft support member is moved by pressurized air through said bore of said housing toward said first end thereof;

wherein said hook-like member is adapted to hook about the nail head of the nail upon said hook-like member being retracted into said tubular shaft support member, said hook-like member being movable in said tubular shaft support member and being engageable to a side wall of said tubular shaft support member;

wherein said gear member is a worm gear and said drive shaft includes a spirally threaded second end portion which is engageable to said worm gear for retracting said drive shaft in said housing, said second end portion of said drive shaft being extendable through and supported by support members, said support members being attached to said housing.

11. An air-driven nail puller device as described in claim 10, wherein said means for forcing said first end of drive shaft outwardly of said housing includes:

an air cylinder having an air-inlet port and an air-outlet port;

a tubular member having a bore extending therethrough and having a first end being attached to said air-outlet port of said air cylinder and also having a second end being disposed proximate to said tubular shaft support member;

a conduit member having one end attached to said air-inlet port; and a hose attachment fitting disposed through a wall of said housing and being connected to said conduit member and being adapted to be connected to an air source;

wherein said means for retracting said first end of said drive shaft within said housing includes:

an air motor disposed in said housing and being connected to said conduit member and having a motor shaft rotatably connected to said air motor;

a gear member being mounted to said motor shaft and being engagable to said drive shaft for retracting said drive shaft within said housing; and a trigger switch being movably disposed in said wall of said housing and being connected to said air motor for energizing said air motor;

wherein said motor shaft is journaled through bearings and into said wall of said housing;

wherein said tubular shaft support member is disposed in said bore of said housing, said tubular shaft support member including:

an open first end which disposed near said first end of said housing;

an open second end to which said second end of said tubular member is connected;

a side wall which is outwardly tapered at said first end of said tubular shaft support member.

* * * * *